US008985657B1

(12) United States Patent
Burns

(10) Patent No.: US 8,985,657 B1
(45) Date of Patent: Mar. 24, 2015

(54) SPILL PROOF PLATTER APPARATUS

(71) Applicant: James Arthur Burns, Lake Elmo, MN (US)

(72) Inventor: James Arthur Burns, Lake Elmo, MN (US)

( * ) Notice: Subject to any disclaimer, the term of this patent is extended or adjusted under 35 U.S.C. 154(b) by 0 days.

(21) Appl. No.: 14/294,208

(22) Filed: Jun. 3, 2014

(51) Int. Cl.
*A47G 23/06* (2006.01)

(52) U.S. Cl.
CPC ..... *A47G 23/06* (2013.01); *A47G 23/0633* (2013.01)
USPC ..... 294/172; 206/565; 220/23.83

(58) Field of Classification Search
CPC ..... A47G 23/06; A47G 23/0633
USPC ..... 294/144, 145, 146, 159, 160, 165, 172; 206/557, 558, 560, 562–565; 220/23.83
See application file for complete search history.

(56) References Cited

U.S. PATENT DOCUMENTS

| | | | | |
|---|---|---|---|---|
| 1,962,556 | A * | 6/1934 | Eberhardt, Jr. | 206/562 |
| 2,845,207 | A * | 7/1958 | Klinghoffer | 220/23.83 |
| 3,233,804 | A * | 2/1966 | Dahm | 294/160 |
| 3,250,422 | A * | 5/1966 | Parish | 220/23.83 |
| 4,534,469 | A * | 8/1985 | Elsmo | 206/560 |
| 4,908,066 | A * | 3/1990 | Taylor et al. | 108/26 |
| 6,145,905 | A * | 11/2000 | Carpenito | 294/159 |
| 7,845,845 | B1 * | 12/2010 | Kelly | 366/274 |
| 7,992,714 | B1 * | 8/2011 | Devault et al. | 206/564 |
| 8,272,506 | B1 * | 9/2012 | Flannery et al. | 206/217 |
| 8,291,831 | B2 * | 10/2012 | Spano | 108/25 |
| 2011/0290697 | A1 * | 12/2011 | Dalhamer | 206/557 |

* cited by examiner

*Primary Examiner* — Dean Kramer
(74) *Attorney, Agent, or Firm* — Haugen Law Firm PLLP

(57) ABSTRACT

A spill-proof platter apparatus is arranged to minimize spillage of items supported thereon during transport and use. The platter apparatus employs connector fixtures secured to a holder plate at one or more locations in a predetermined pattern. Receivers taking the form of beverage container braces, plates, bowls, and the like are removably engaged to the connector fixtures to locate beverage and food related items at a fixed position of the platter apparatus.

18 Claims, 7 Drawing Sheets

SPILL PROOF PLATTER APPARATUS

FIELD OF THE INVENTION

The present invention relates generally to platters or trays for supporting and/or transporting food and beverage items, and more particularly platter/tray apparatus that is adapted for retaining dining items in a manner that minimizes the likelihood of spillage. The platter/tray apparatus of the present invention facilitates secure and efficient placement of items such as beverage containers, plates, and bowls in a relatively compact area defined within the outer perimeter of the platter.

BACKGROUND OF THE INVENTION

A variety of situations arise in which food and/or beverage is served and/or transported on a portable service device. Most typically, such portable service devices are trays or platters that define a carrying surface area that is large enough to support a plurality of food and beverage items, such as beverage containers, plates, and bowls, but yet small enough to be transported by a single person. The trays may be sized and configured primarily for personal use to accommodate single serving portions of the food and beverage items. In other cases, the trays may be sized and configured to support serving portions of food and/or beverage items suitable for a plurality of people. For both situations, transport of the service trays introduces the risk of spillage of the supported food or beverage items. Such service trays are also commonly employed in situations involving uneven and/or unsteady support surfaces. For example, service trays may be used on people's laps, as well as in moving vehicles, such as automobiles and boats. Clearly, such applications also introduce the risk of spillage of the food or beverage items.

While it is common for conventional trays/platters to include integral or detachable dividers for defining discrete zones at the tray surface for separating different food and beverage items, there remains a need to retain food and beverage items at a tray/platter in a spill-proof manner. A beneficial improvement from conventional trays would be an apparatus which facilitates the selective engagement of items such as beverage container braces, bowls, plates, bowl braces, and plate braces into a fixed position with respect to the platter, so that the food and beverage items are restrained from displacement along the platter surface.

SUMMARY OF THE INVENTION

By means of the present invention, items such as food and beverage items may be securely retained at a platter/tray, so as to minimize the likelihood of spillage. The apparatus of the present invention employs one or more connector fixtures at predetermined locations of the platter/tray, with the connector fixtures being adapted to securely engage a receiver thereat. The receiver may take various forms, including a beverage container brace, a bowl, a plate, a bowl brace, a plate brace, or a utensil holder. The predetermined locations of the connector fixtures may preferably be optimized to facilitate secure reception of items, such as food and beverage items, in as small of area as possible. The efficient use of space available on the platter provides further utility to this invention.

In one embodiment, a platter apparatus of the present invention includes a holder plate having opposed upper and lower surfaces and a perimeter, and an array of a plurality of attachment details at the upper surface. The platter apparatus further includes a connector fixture attachable to the holder plate at a respective attachment detail, wherein the connector fixture includes a first mating structure configured for engagement to the attachment detail. A receiver includes an engagement portion that is configured for removable securement to a second mating structure of the connector fixture, and the receiver includes a second portion that is configured for supporting a food or beverage item.

In another embodiment, the platter apparatus of the present invention includes a holder plate having opposed upper and lower surfaces and a perimeter defining a platter area. The apparatus further includes a connector fixture integrally formed with the upper surface of the holder plate, and a receiver having an engagement portion that is configured for removable securement to a mating structure of the connector fixture to retain the receiver in a fixed position relative to the holder plate. The receiver includes a second portion in the form of a beverage container brace, a bowl, a bowl brace, a plate, or a plate brace, wherein the beverage container brace includes a substantially cylindrical side wall defining a holder chamber with a height and a diameter suitable for retaining a beverage container at the receiver.

DETAILED DESCRIPTION OF THE PREFERRED EMBODIMENTS

Figure 1A:
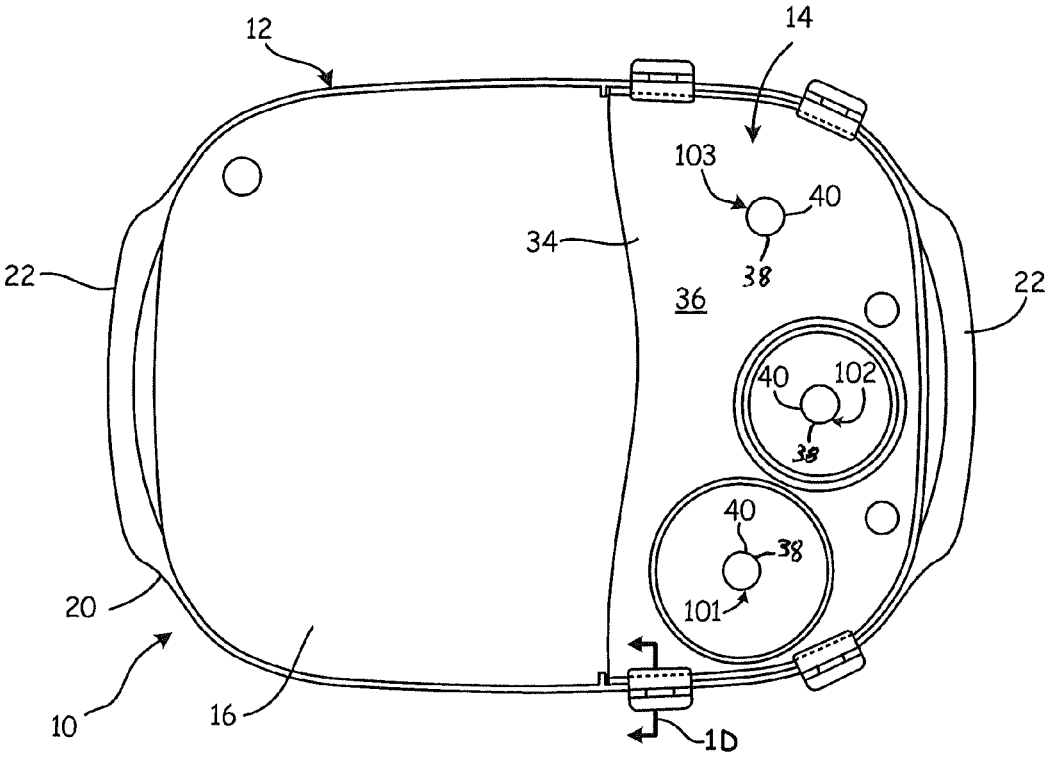
FIG. 1A is a top plan view of a platter apparatus of the present invention.
Figure 1B:
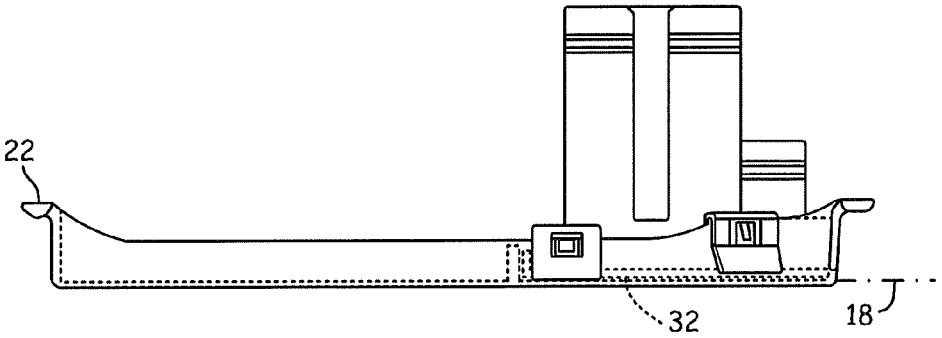
FIG. 1B is a side elevational view of the platter apparatus of FIG. 1A.
Figure 1C:
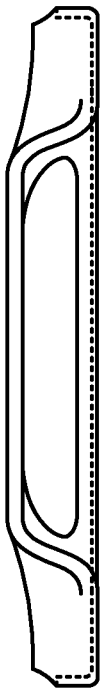
FIG. 1C is an end elevational view of the platter apparatus of FIG. 1A.
Figure 1D:
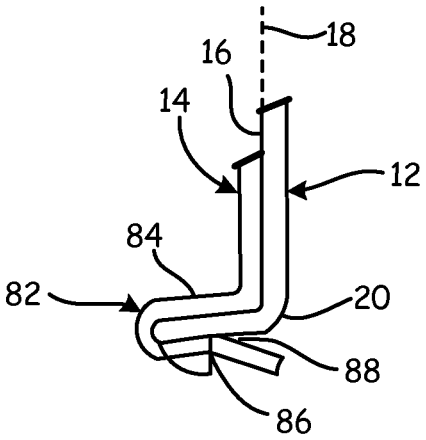
FIG. 1D is a cross-sectional view of a portion of the platter apparatus of FIG. 1A.

The present invention provides, in some embodiments, a spill-proof food and beverage serving system within a versatile family of platters/trays for a wide variety of dining situations. For the purposes hereof, the terms "platter" and "tray" may be used interchangeably, and are intended to mean a structure designed to support a collection of items, such as food and beverage items for various serving applications. The platters may be configured to maintain plates, bowls, beverage containers, and other items at the platter while transporting and/or serving the items, or simply while using the items, such as in a dining setting. Example applications in which the platters of the present invention may be found to be useful include lap dining, outdoor dining, serving in a stationary or moving vehicle, such as an automobile, boat, or aircraft, and other situations in which stable retention of items at the platter is desired.

The objects and advantages enumerated above together with other objects, features, and advances represented by the present invention will now be presented in terms of detailed embodiments described with reference to the attached drawing figures which are intended to be representative of various possible configurations of the invention. Other embodiments and aspects of the invention are recognized as being within the grasp of those having ordinary skill in the art.

Unless otherwise apparent or stated, directional references, such as "upper", "lower", "front", "rear", "vertical", "horizontal", "top", "bottom", and the like are intended to be relative to the orientation of a particular embodiment of the invention as shown in the figures. In addition, a given reference number in the drawings indicates the same or similar structure when it appears in different figures, and like reference numerals identify similar structural elements and/or features of the subject invention.

With reference now to the drawing figures, and first to FIGS. 1A-1D, a platter apparatus 10 includes a base plate 12 and a holder plate 14 for removable engagement with base plate 12. The illustrated embodiment in FIGS. 1A-1D depict a combination of base plate 12 and holder plate 14. In this embodiment, base plate 12 includes a base 16 in a base plane 18, and a side wall 20 extending upwardly from base 16 and out from base plane 18. In the illustrated embodiment, side wall 20 extends substantially perpendicularly to base plane 18. Base plate 12 may further include handle elements 22 formed integrally with, or attached to side wall 20 to assist in carrying platter apparatus 10. It is contemplated that base plate 12 may be provided in a variety of configurations deemed most useful for the intended application, and may be fabricated from a variety of materials. In most embodiments, base plate 12 may be a molded plastic structure.

Base 16 of base plate 12 may extend continuously or discontinuously throughout an area bounded by sidewall 20. In the illustrated embodiment, base 16 is substantially planar at both an upper and a lower surface thereof. In other embodiments, base 16 may include protrusions, ridges, recesses, textures, patterns, or the like, as necessary or desired.

Figure 2A:
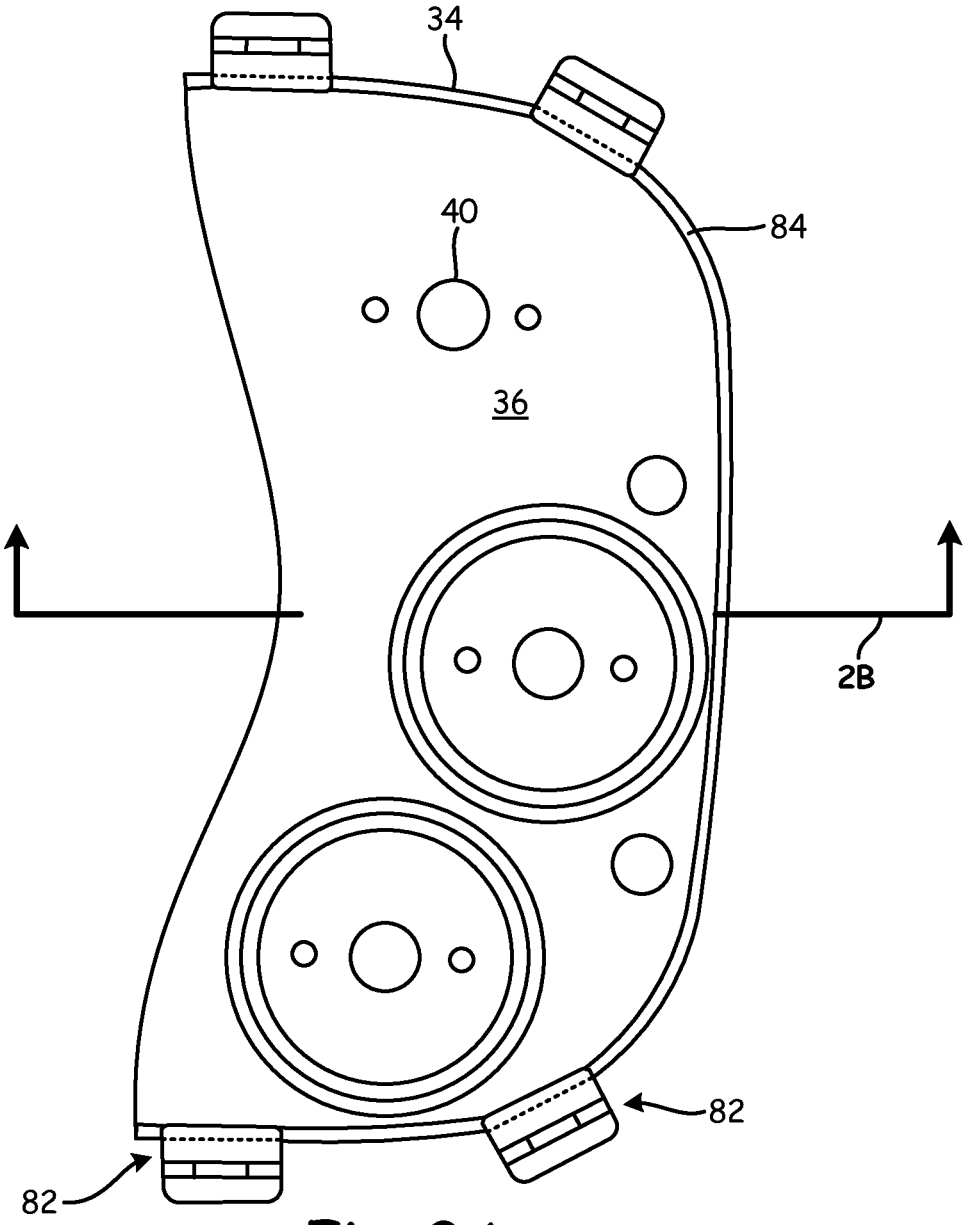
FIG. 2A is a top plan view of a portion of the platter apparatus of FIG. 1A.
Figure 2B:
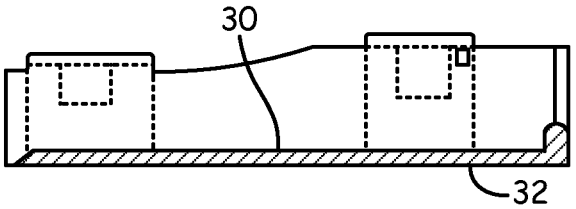
FIG. 2B is a side elevational view of the portion of the platter apparatus shown in FIG. 2A.

Holder plate 14 includes opposed upper and lower surfaces 30, 32 and a perimeter 34 which defines a platter area 36 of upper surface 30. As may be seen from the illustrated embodiments, perimeter 34 may establish a regular or irregular platter area 36, wherein less than an entirety of perimeter 34 may be congruent with side wall 20 of base plate 12. As shown in FIG. 1A, for example, holder plate 14 may cover only a portion of base plate 12, wherein a portion of perimeter 34 follows the shape of side wall 20, while another portion of perimeter 34 diverges from adjacency with side wall 20. In other embodiments, however, perimeter 34 follows or tracks alongside wall 20 of base plate 12 so as to closely fit within a platter zone defined by side wall 20 of base plate 12. Holder plate 114 illustrated in FIGS. 2*a* and 2*b* provides an example of such a regular configuration for perimeter 34 that may or may not closely fit within a platter zone of base plate 12.

Figure 4A:
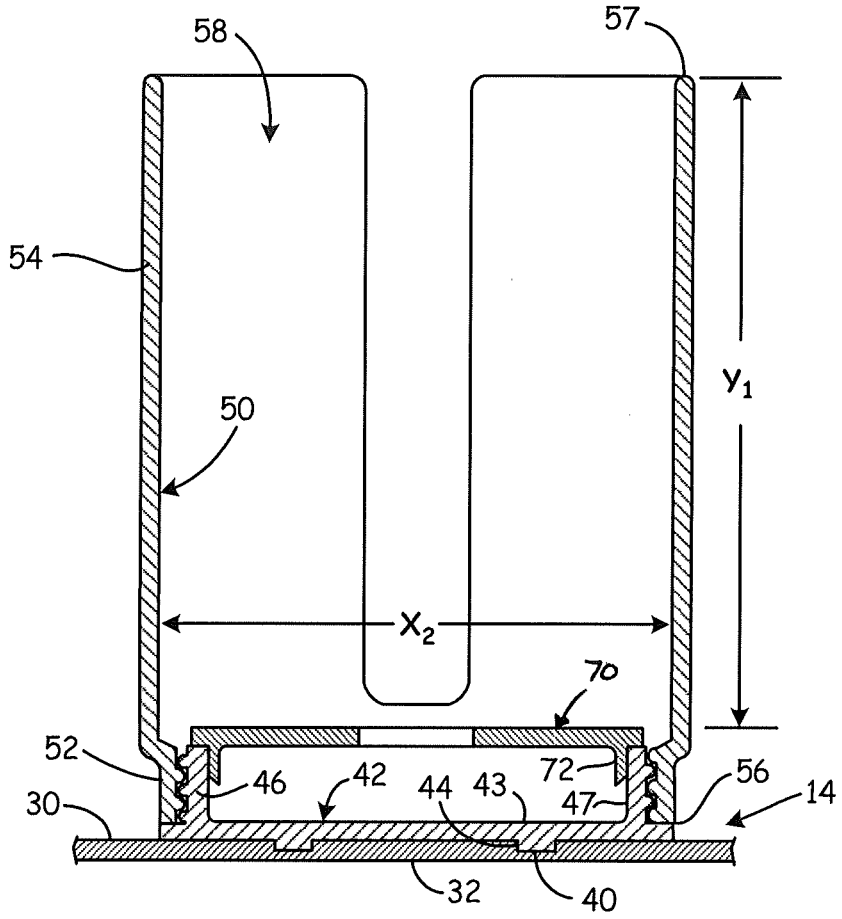
FIG. 4A is a cross-sectional view of a platter apparatus of the present invention.
Figure 4B:
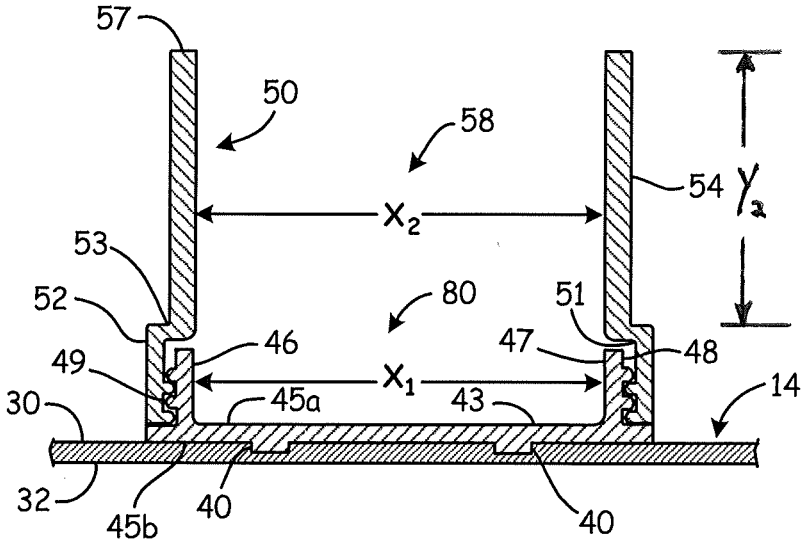
FIG. 4B is a cross-sectional view of a platter apparatus of the present invention.

In some embodiment, holder plate 14 includes an array 38 of a plurality of attachment details 40 at upper surface 30. As illustrated in FIGS. 4A and 4B, attachment details 40 may be in the form of receptacles in upper surface 30 of holder plate 14. Such receptacles may be of any useful configuration, with the illustrated receptacles forming a substantially cylindrical opening into upper surface 30. In addition to the illustrated receptacle form of attachment details 40, it is contemplated that one or more of attachment details 40 in array 38 may instead be protrusions extending from upper surface 30 of holder plate 14. Thus, array 38 may include a plurality of attachment details in the form of receptacles, protrusions, or combinations thereof. As will be described in greater detail hereinbelow, attachment details 40 are preferably configured for engagement with respective connector fixture 42.

As best illustrated in FIGS. 4-5, connector fixture 42 is attachable to holder plate 14, and locatable at one or more respective attachment details 40. To so secure to holder plate 14, connection FIG. 42 includes a first mating structure 44 that is configured for engagement to a respective attachment detail 40. In the illustrated embodiment, first mating structure 44 may be in the form of a protrusion or nub that closely fits within the receptacle of attachment detail 40. A variety of arrangements and mechanisms are envisioned by the present invention to effectuate the engagement between first mating structure 44 and attachment detail 40. In some embodiments, first mating structure 44 may be configured for mating engagement with attachment detail 40. Thus, first mating structure 44 may be in the form of protrusions, recesses, or combinations thereof that are configured to matingly engage with a correspondingly-configured attachment detail 40. First mating structure 44 may be engageable with attachment detail 40 through a mechanical registration, such as a press-fit, a snap-fit, a tab and recess engagement, and the like. First mating structure 44 may also or instead be engageable with attachment detail 40 through a weld, adhesives, or other bonding mechanisms. Likewise, lower surface 45*b* of connector fixture 42 may be secured to upper surface 30 of holder plate 14 through one or more of a variety of attachment means, such as welding, including sonic welding, adhesives, mechanical mechanisms, including hook and loop fasteners, and other bonding and/or attachment mechanisms. It is contemplated that the engagement of first mating structure 44 and attachment detail 40 may primarily provide a locating function for placement of connector fixture 42 at predetermined positions of holder plate 14, while the main attachment is found at the interface between lower surface 45*b* of connector fixture and upper surface 30 of holder plate 14. In some embodiments, the engagement of first mating structure 44 and attachment detail 40 may restrain undesired rotation of connector fixture 42 with respect to holder plate 14, so as to avoid undue stress on the attachment between connector fixture 42 and holder plate 14. Connector fixture 42 may be removably or permanently attached to holder plate 14 and located at predetermined positions at holder plate 14 through a removable or permanent engagement between first mating structure 44 and attachment detail 40, as desired.

One or more connector fixtures 42 may be attached to holder plate 14 at predetermined locations defined by attachment details 40. As will be further described below, array 38 of attachment details 40 may be provided in a predetermined pattern to most efficiently locate food and beverage receivers, such as beverage containers, bowls, and plates within platter area 36.

A receiver 50 includes an engagement portion 52 that is configured for removable securement to a second mating structure 46 of connection fixture 42. It is contemplated that a variety of arrangements and/or mechanisms may be employed to accomplish the removable securement of engagement portion 52 of receiver 50 to second mating structure 46 of connection fixture 42. Examples include mechanical registration, threadable engagement, and the like.

FIGS. 4A and 4B illustrate an example embodiment for connector fixture 42 and receiver 50, in which engagement portion 52 of receiver 50 is threadably engaged with second mating structure 46 of connector fixture 42. In this embodiment, connector fixture 42 includes a base portion 43 with upper and lower surfaces 45*a*, 45*b*. First mating structure 44, in this embodiment, extends from lower surface 45*b* to engage with attachment details 40. The engagement of connector fixture 42 with holder plate 14 may bring lower surface 45*b* into contact with upper surface 30 of holder plate 14. Second mating structure 46 of connector fixture 42 may include an upright wall portion 47 extending from upper surface 45*a* of base portion 43. In some embodiments, upright wall portion 47 may be substantially cylindrical and extending substantially perpendicularly from upper surface 45*a* of base portion 43. Outer wall surface 48 of upright wall portion 47 may include threads 49 that are sized and pitched to threadably engage with receiver threads 53 at an inner surface 51 of engagement portion 52.

Upright wall portion 47 may bound and define a central region 80 having a diameter $X_1$. In some embodiments, diameter $X_1$ of central region 80 may be specifically dimensioned to accommodate particular food or beverage items. For example, a beverage container such as a bottle, can, cup, mug, or glass may be positioned at central region 80. By providing diameter $X_1$ with a dimension that is similar to a diameter of such a beverage container, upright wall portion 47 may aid in retaining such beverage container at central region 80. In particular, diameter $X_1$ may be only slightly larger than an outer diameter dimension of the beverage container to assist in stabilizing such beverage container at central region 80. An example dimension for dimension $X_1$ may be about 2.75 inches, which corresponds to standard beverage container bottles. Other dimensions for diameter $X_1$, however, are also contemplated by the present invention, including dimensions that may be suitable to aid in supporting other food or beverage items.

Engagement portion 52 of receiver 50 is preferably appropriately configured to coordinate with second mating structure 46 of connector fixture 42. As illustrated in FIGS. 4A and 4B, engagement portion 52 includes receiver threads 53 for threadable engagement with threads 49 at outer wall surface 48 of upright wall portion 47. Full threadable engagement of engagement portion 52 to second mating structure 46 may be achieved when end surface 56 of engagement portion 52 engages upper surface 45*a* of base portion 43 of connector fixture 42. Thus, upper surface 45*a* acts as an engagement stop for the threadable engagement of receiver 50 to connector fixture 42.

Receiver 50 further includes a second portion 54 that may be configured for supporting a food or beverage item. In the embodiments of FIGS. 4-5, second portion 54 is in the form of a beverage container brace having a substantially cylindrical side wall defining a holder chamber 58 with a height $Y_1$ and a diameter $X_2$. Second portion 54 of receiver 50 may therefore be configured as desired to assist in retaining an item, such as a food or beverage item, at a fixed position relative to holder plate 14. In the embodiment illustrated in FIG. 4B, diameter $X_2$ of holder chamber 58 may be substantially equal to diameter $X_1$ of central region 80 to establish a substantially continuous boundary wall from upper surface 45*a* of base portion 43 to upper end surface 57 of second portion 54. In other embodiments, a somewhat larger dimension for diameter $X_2$ is desired, as illustrated in FIG. 4A. Such a larger diameter $X_2$ for holder chamber 58 may be appropriate for retaining larger beverage containers, such as wine bottles and the like. In one instance, diameter $X_2$ may be about 3.4 inches. It may also be recognized that height $Y_1$ of holder chamber 58 in FIG. 4A may be greater than height $Y_2$ of holder chamber 58 in the embodiment of FIG. 4B. Example height dimensions for heights $Y_1$ and $Y_2$ are between 2-5 inches. Various sizes and configurations for second portion 54 of receiver 50 are contemplated by the present invention, each of which are suitable to retain the food or beverage item at receiver 50, even during transport of platter apparatus 10. Besides the beverage container brace configurations illustrated in FIGS. 4-5, second portion 54 of receiver 50 may be in the form of, for example, a bowl, a plate, a bowl brace, or a plate brace. Consequently, the term food or beverage items may include containers of food or beverage, as well as food and/or beverage itself. Platter apparatus 10 of the present invention may therefore include a set of receivers 50 for selective engagement with one or more connector fixtures 42, wherein the set of receivers includes receivers 50 with different holder chamber diameters X and/or different holder chamber heights Y, as well as with varying configurations to serve various purposes.

A false bottom element 70 may be utilized for establishing a flat bottom to holder chamber 58. In the embodiment illustrated in FIG. 4A, false bottom element 70 includes a retention ring 72 for frictional securement to upright wall portion 47. Retention ring 72 may therefore have an outer diameter that is substantially equal to diameter $X_1$ of central region 80, so as to be press-fit against upright wall portion 47 of second mating structure 46.

Figure 5A:
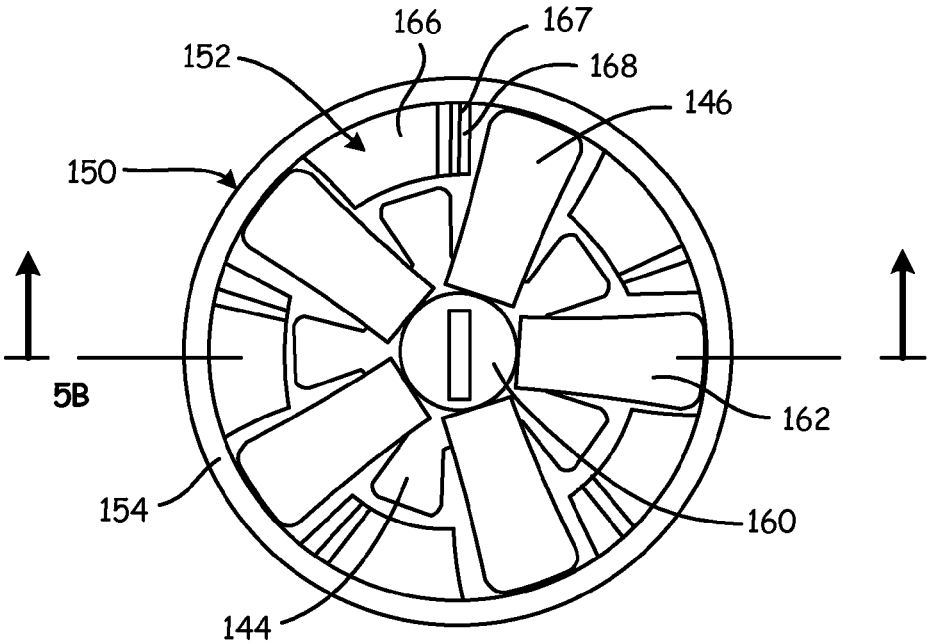
FIG. 5A is a top plan view of a portion of a platter apparatus of the present invention.
Figure 5B:
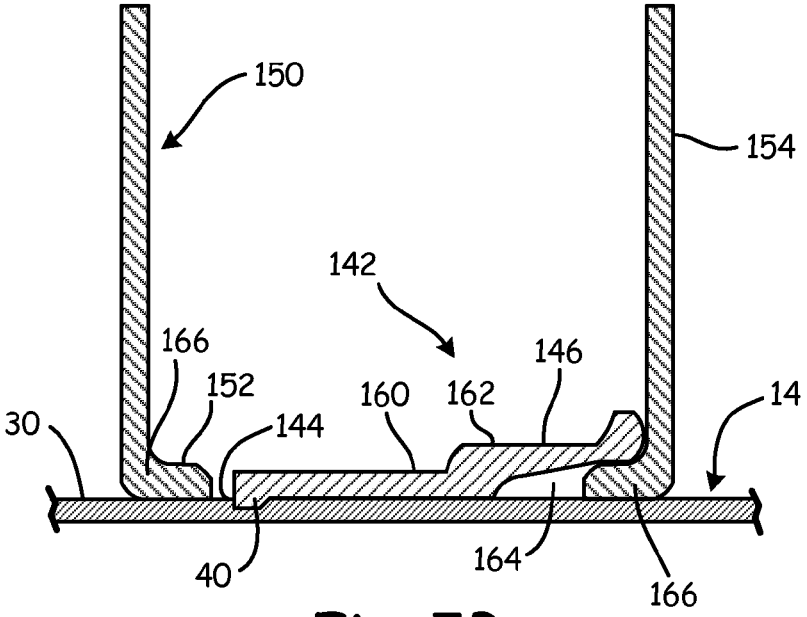
FIG. 5B is a cross-sectional view of the platter apparatus shown in FIG. 5A.

Another embodiment of connection fixture 42 and receiver 50 is illustrated in FIGS. 5A and 5B, with the cross-sectional view of FIG. 5B taken along section line A-A in FIG. 5A. In this embodiment, connector fixture 142 includes a first mating structure 144 configured for engagement with attachment detail 40 of holder plate 14. Second mating structure 146 of connector fixture 142 includes a stem portion 160 and a plurality of connection spokes 162 extending radially outwardly from stem portion 160. Connection spokes 162 may preferably be spaced from upper surface 30 of holder plate 14 to define a retention gap 164. Connector fixture 142 may be secured to holder plate 14 as described above with reference to connector fixture 42.

Engagement portion 152 of receiver 150 includes a retaining tab for engagement in retention gap 164 between a respective connection spoke 162 and upper surface 30 of holder plate 14. Retaining tab 166 may extend radially inwardly from second portion 154 of receiver 150. This engagement arrangement illustrated in FIGS. 5A and 5B may be referred to as a twist-on bayonet mount, with engagement portion 152 of receiver 150 being rotated underneath respective connection spokes 162 of second mating structure 146 to retain receiver 150 at connector fixture 142. Connection spokes 162 may be somewhat deflectable as retaining tabs 166 are brought into engagement therewith in retention gap 164. The deflectability of connection spokes 162 provides a spring-like hold-down force on retaining tab 166 to secure retain tab 166 between connection spoke 162 and upper surface 130 of holder plate 114.

In some embodiments, retaining tabs 166 may include a sloped portion 168 at a leading edge 167. Sloped portion 168 aids in upwardly deflecting the respective connection spoke 162 as receiver 150 is rotated to position retaining tab 166 into retention gap 164. Sloped portion 168 results in a thinner leading edge 167 than the remainder of retaining tab 166.

Figure 3A:
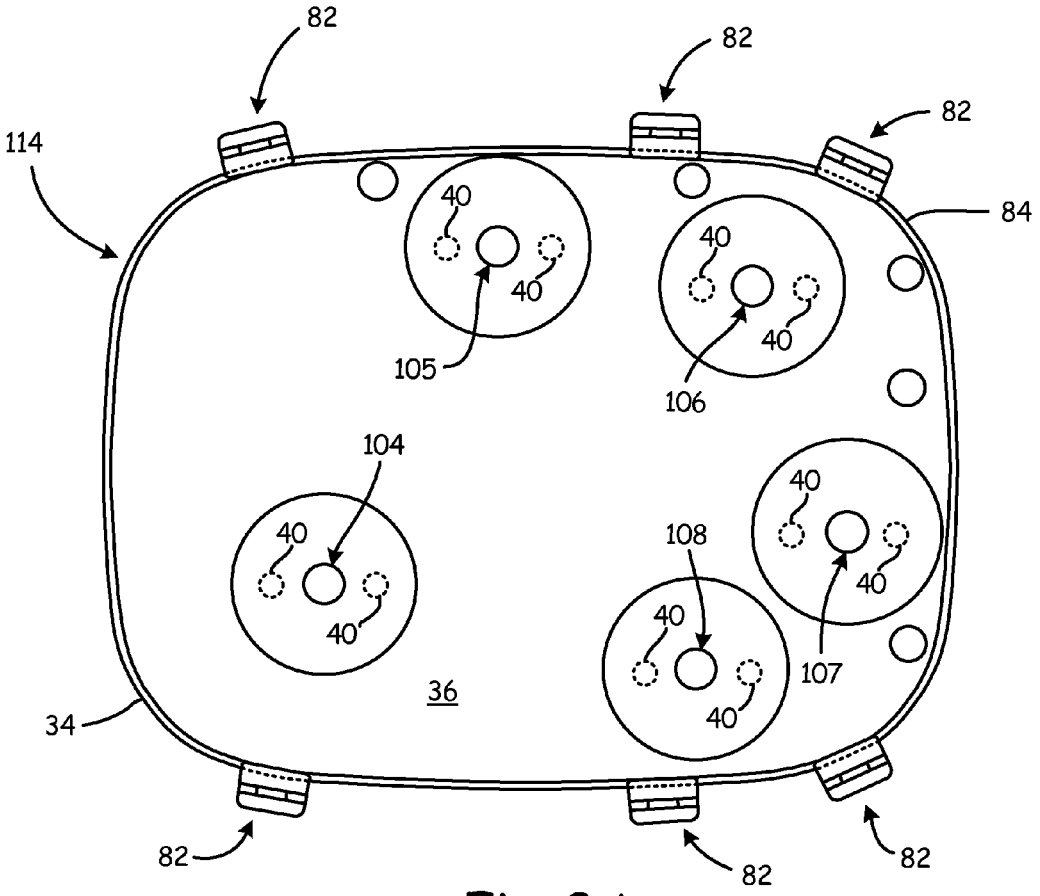
FIG. 3A is a top plan view of a portion of a platter apparatus of the present invention.
Figure 3B:
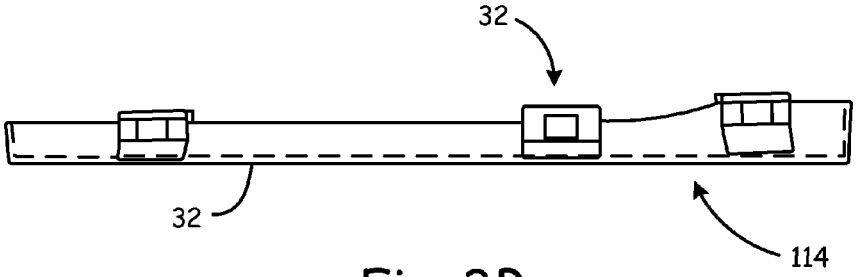
FIG. 3B is a side elevational view of the platter apparatus portion shown in FIG. 3A.

As best illustrated in FIGS. 2-3, holder plate 14 may include latch elements 82 extending from upper surface 30 at perimeter 34. Latch elements 82 may be configured for removable engagement to side wall 20 of base plate 12 to bring base plate 12 into contact with lower surface 32 of holder plate 14. In some embodiments, holder plate 14 may include a lip 84 extending upwardly from upper surface 30 at perimeter 34. In such embodiments, latch elements 82 may be secured to, or be integrally formed with, lip 84. As shown in the cross-sectional view of FIG. 1D, latch element 82 includes a latch arm 86 that defines a latch gap between latch arm 86 and lip 84. Latch arm 86 may be deflected outwardly to permit entry of side wall 20 into latch gap 88. A resilient restorative force acts upon latch arm 86 to engage side wall 20 in latch gap 88 between latch arm 86 and lip 84. A variety of arrangements for latch element 82, however, are contemplated as being useful in the present invention.

In some embodiments of the invention, connector fixture 42 may be integrally formed with upper surface 30 of holder plate 14. For the purposes hereof, the term "integrally formed" is intended to mean co-molded or otherwise simultaneously formed in the manufacturing process. It is therefore contemplated that one or more connector fixtures 42 may be arranged in a predetermined pattern at holder plate 14 to permit the selective securement of a plurality of receivers 50 within platter area 36.

An aspect of the present invention is a provision of attachment details 40 and/or connector fixtures 42 in a predetermined pattern to permit the selective securement of a plurality of receivers 50 within platter area 36. Preferably, such predetermined pattern is prepared with a set of receivers 50 in mind, so as to most efficiently accommodate the selected receivers 50 within platter area 36. Various combinations of different receivers 50 may be envisioned as receiver sets that may be most efficiently placed at an associated array 38 of attachment details 40, or with an associated array of connector fixtures 42. Such various receivers 50 may include, for example, small beverage container braces, large beverage container braces, bowl braces, plate braces, utensil receptacles, bowls, plates, and the like. Example arrays 38 are illustrated in the drawings. In FIG. 1A, a large beverage container brace is illustrated as being secured at position 101, while a small beverage container brace is secured to position 102. Position 103 is shown unoccupied and available for securement of a connector fixture 42/receiver 50 combination. FIG. 3A illustrates another example array 38 in which a variety of receivers 50 may be secured at respective positions 104-108. In an example arrangement, a large bowl may be placed at position 104, while a smaller bowl may be placed at position 105, and any combination of beverage container braces at positions 106-108. It should also be understood that separate bowls, plates, or beverage containers may be placed at holder plate 14 without a connector fixture 42/receiver 50 combination. That is, users may wish to employ beverage container braces as receivers 50 in combination with connector fixtures at positions 106-108 while simply placing bowls, plates, or other objects at positions 104 and 105 without retentive securement to holding plate 14 through a connector fixture 42/receiver 50 combination.

Figure 6:
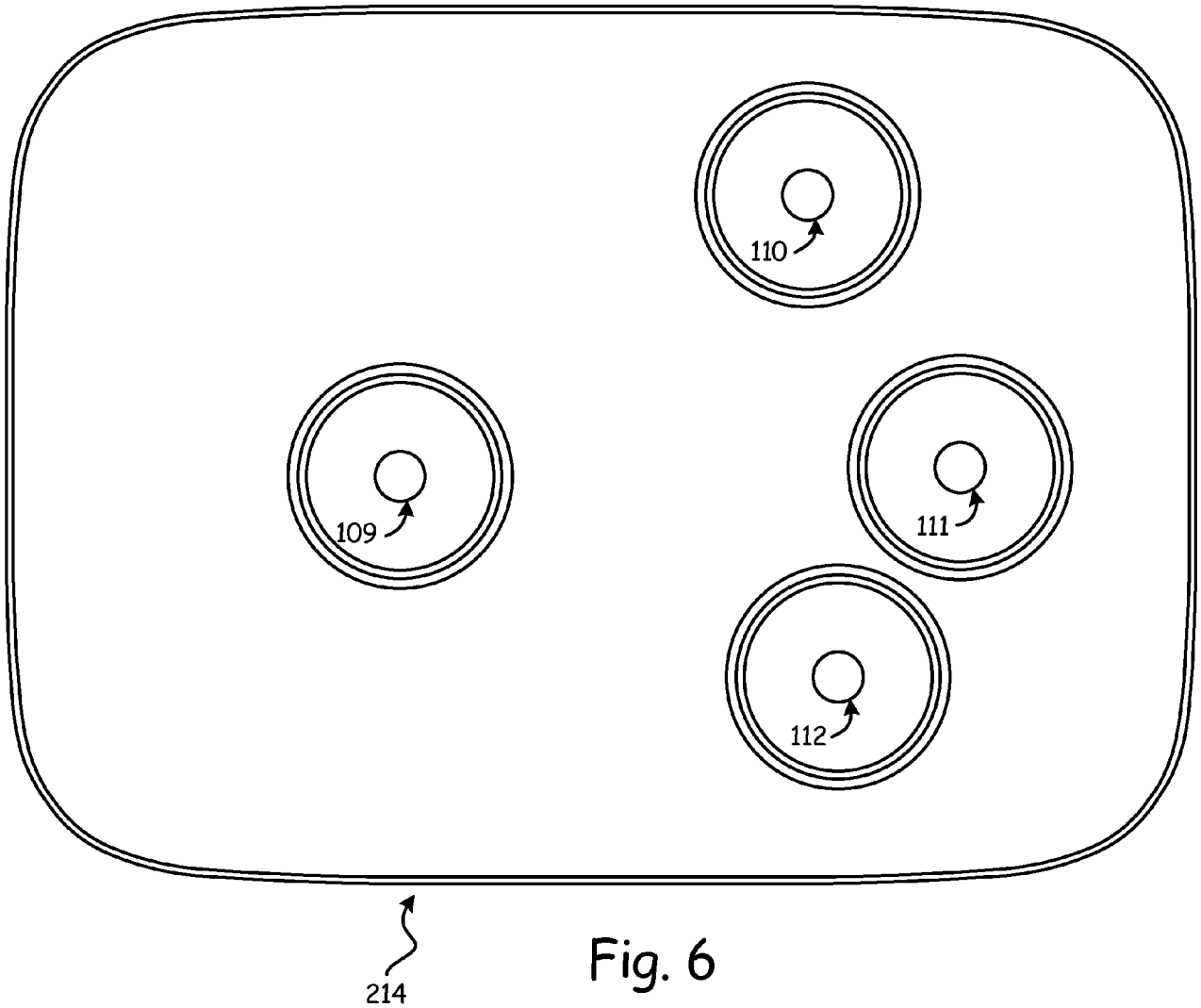
FIG. 6 is a top plan view of a platter apparatus of the present invention.

A still further example array 38 is illustrated in FIG. 6 with positions 109-112 shown at holder plate 214. In this embodiment, holder plate 214 may be utilized without a base plate, such as base plate 12. Various modifications to holder plate 214 are contemplated by the present invention, including the incorporation of integral or detachable handles, a sidewall, or the like, so that holder plate 14, itself, may be used as a platter, a carrying tray, or other functional carrier type. An example arrangement of receivers 50 at the array illustrated in FIG. 6 may include a plate at position 109, a bowl at position 110, and either small or large beverage container braces at positions 111 and/or 112.

It is contemplated that receivers 50 may be nested for compact shipping, display, and storage. A variety of molding methods may be employed to manufacture the components of the present invention. With regard to beverage container braces, a minimal draft system may be used to enable a straight core pull. However, if mold economies permit, it may be desirable to mold without a draft.

Base plate 12 may be configured differently than a typical carrying tray, in that it may have lower sides to enable the user to utilize the base plate 12 while dining. In some embodiments, side wall 20 of base plate 12 may have a height that is less than the height dimension of a typical plate including for paper plates. Additionally, base plate 12 and holder plate 14 may be rounded on all sides to present a "soft" and plate-like appearance when on a table or counter. The components of platter apparatus 10 may be fabricated from a transparent or translucent material, such as polycarbonate. Platter apparatus 10 may further include a grip element at a bottom surface of base 16, and/or at lower surface 32 of holder plate 14 to minimize sliding and marking/damage to the lower surface. The grip element may include elastomeric feet, a rubber-like bottom rim, or other similar features.

Base plate 12 may include a relatively smooth surface to facilitate cleaning. Holder plate 14 may include drainage apertures and other apertures for connection to storage hangers or the like. Receivers 50 may similarly include drainage apertures and storage apertures.

Receivers 50 may be provided in matching sets, including one or more of plates, bowls, drinking cups, and the like.

The invention has been described herein in considerable detail in order to comply with the patent statutes, and to provide those skilled in the art with the information needed to apply the novel principles and to construct and use embodiments of the invention as required. However, it is to be understood that various modifications may be accomplished without departing from the scope of the invention itself.

What is claimed is:

1. A platter apparatus, comprising:

a holder plate having opposed upper and lower surfaces and a perimeter, and an array of a plurality of attachment details at said upper surface;

a connector fixture attachable to said holder plate at a respective said attachment detail, wherein said connector fixture includes a first mating structure configured for engagement to said attachment detail;

a receiver having an engagement portion that is configured for removable securement to a second mating structure of said connector fixture, said receiver including a second portion configured for supporting a food or beverage item;

a base plate for removable engagement with said holder plate, said base plate having a base in a base plane and a sidewall extending upwardly from said base and out from said base plane; and latch elements extending from said upper surface of said holder plate at said perimeter, said latch elements being configured for removable engagement to said side wall of said base plate to bring said base plate into contact with said lower surface of said holder plate.

2. A platter apparatus as in claim 1 wherein said attachment details are arranged in a predetermined pattern in said array to permit securement of a plurality of said receivers within a platter area defined by said perimeter.

3. A platter apparatus as in claim 1 wherein said attachment details include receptacles in said upper surface of said holder plate, protrusions extending from said upper surface of said holder plate, or combinations thereof.

4. A platter apparatus as in claim 3 wherein said first mating structure is configured for mating engagement with said attachment detail.

5. A platter apparatus as in claim 1 wherein said first mating structure is engageable with said attachment detail through mechanical registration.

6. A platter apparatus as in claim 1 wherein said first mating structure is engageable with said attachment detail through a weld.

7. A platter apparatus as in claim 1 wherein said engagement portion of said receiver is threadably engageable with said second mating structure of said connector fixture.

8. A platter apparatus as in claim 1 wherein said removable securement of said engagement portion to said second mating structure of said connection fixture retains said receiver in a fixed position relative to said holder plate.

9. A platter apparatus as in claim 1 wherein said second portion of said receiver is in the form of a beverage container brace having a substantially cylindrical side wall defining a holder chamber with a height and a diameter.

10. A platter apparatus as in claim 9, including a set of receivers for selective engagement with said connector fixture, said set of receivers including receivers with different holder chamber diameters or different holder chamber heights.

11. A platter apparatus as in claim 1, wherein said second portion of said receiver is in the form of a bowl, a plate, a bowl brace, or a plate brace.

12. A platter apparatus, comprising:

a holder plate having opposed upper and lower surfaces and a perimeter, and an array of a plurality of attachment details at said upper surface;

a connector fixture attachable to said holder plate at a respective said attachment detail, wherein said connector fixture includes a first mating structure configured for engagement to said attachment detail; and a receiver having an engagement portion that is mechanically registrable with a second mating structure of said connector fixture, said second mating structure including a stem portion and a plurality of connection spokes extending radially outwardly from said stem portion, said receiver including a second portion configured for supporting a food or beverage item.

13. A platter apparatus as in claim 12 wherein said engagement portion of said receiver includes a retaining tab for engagement between a respective said connection spoke and said upper surface of said holder plate.

14. A platter apparatus as in claim 12 wherein said retaining tab includes a sloped portion at a leading edge of said retaining tab.

15. A platter apparatus, comprising:

a holder plate having opposed upper and lower surfaces and a perimeter defining a platter area, and a plurality of attachment details at said upper surface;

a connector fixture locatable at a respective said attachment detail for securement to said holder plate, said connector fixture including a first mating structure configured for engagement to said attachment detail, a base portion, and a second mating structure including a substantially cylindrical upright wall portion extending from said base portion to define a circumaxial wall extending circumaxially about a connector fixture axis that extends substantially perpendicularly to said upper surface of said holder plate to define an axial direction and a radial direction, said upright wall portion bounding a central region to define a first inner diameter, said upright wall portion having a threaded annular wall surface; and a kit of a plurality of receivers each having an engagement portion that is configured for threadable engagement with said threads at said annular wall surface of said upright wall portion, a first one of said receivers having a second portion with a substantially cylindrical side wall extending circumaxially about said connector fixture axis and generally axially upwardly from said engagement portion, said side wall bounding a holder chamber with a second inner diameter that is substantially equal to said first inner diameter, and a second one of said receivers having a second portion with a substantially cylindrical side wall extending circumaxially about said connector fixture axis and generally axially upwardly from said engagement portion, said side wall of said second receiver bounding a holder chamber with a second inner diameter that is greater than said first inner diameter.

16. A platter apparatus as in claim 15, including a false bottom element securable to said upright wall portion of said connector fixture to establish a bottom support surface to the holder chamber that is substantially parallel to said upper surface of said holder plate.

17. A platter apparatus as in claim 16 wherein said bottom support surface is axially displaced from said base portion of said connector fixture.

18. A platter apparatus as in claim 15 wherein said kit includes a third receiver having a second portion with a side wall extending both axially upwardly and radially outwardly from said engagement portion in the shape of a bowl or plate.

* * * * *